United States Patent [19]

Yamamura et al.

[11] 4,167,182

[45] Sep. 11, 1979

[54] MASSAGE APPARATUS

[75] Inventors: Yukio Yamamura; Takafumi Hamabe; Haruo Sugai, all of Hikone, Japan

[73] Assignee: Matsushita Electric Works, Ltd., Osaka, Japan

[21] Appl. No.: 880,272

[22] Filed: Feb. 22, 1978

[30] Foreign Application Priority Data

Feb. 24, 1977 [JP] Japan ..... 52-19984

[51] Int. Cl.[2] ..... A61H 7/00

[52] U.S. Cl. ..... 128/56; 128/57; 128/59

[58] Field of Search ..... 128/57, 58, 24.3, 51, 128/52, 56, 59, 33, 44

[56] References Cited

U.S. PATENT DOCUMENTS

| | | | |
|---|---|---|---|
| 2,633,571 | 1/1952 | Shinagawa et al. | 128/44 |
| 2,840,072 | 6/1958 | Stearns | 128/57 |
| 2,874,689 | 2/1959 | Gavelek | 128/33 |
| 4,016,872 | 4/1977 | Yamamura et al. | 128/44 |

*Primary Examiner*—Lawrence W. Trapp

*Attorney, Agent, or Firm*—Burns, Doane, Swecker & Mathis

[57] ABSTRACT

A massage apparatus performable massaging actions substantially in the same mode as of manual actions by massagers is provided. In driving mechanism for massaging attachments with which massaging force is applied to user's suffering body part, driving and driven side gears are arranged to provide an unequal velocity ratio so that rotating velocity of the driven side gear will be varied as rotated by the driving side gear, whereby the massaging attachments are pushed toward the suffering body part when the velocity of the driven side gear is low and thus with a slowly gradually increased force whereas the pushed attachments are released from the body part when the velocity is high and thus with a quickly decreased force.

8 Claims, 14 Drawing Figures

MASSAGE APPARATUS

This invention relates generally to massage apparatuses and, more particularly, to improvements in the massage apparatuses for performing pushing, gripping, rubbing and releasing actions with respect to suffering body parts substantially in the same mode as of manual massaging actions by massagers.

Generally, in practicing such manual massaging treatment as, for example, finger-pressing, rubbing or the like of stiffened body parts, it has been found the most effective that, as diagramatically shown in FIG. 9 wherein force-applying time t is taken on the abscissa and applied force F is taken on the ordinate, the force is applied to the suffering part so as to repeat a mode in which the push is made slowly, the thus made push is retained for a fixed time and then the push is quickly released. However, in mechanical massage apparatuses suggested hitherto such as, for example, a massage apparatus of a type in which the push is made and released by means of a pair of disk-shaped massaging attachments eccentrically and parallelly or eccentrically and mutually diagonally arranged and mounted to a rotary operating shaft or either one of various other type apparatuses, the operating shaft is caused to rotate at an equal velocity and the applied force F during the massaging operation is of a sine curve represented by $$F=R[1+\sin(\omega t-\pi/2)]$$

wherein R represents a constant, $\omega$ represents an angular velocity which is constant and t represents the time, as diagramatically shown in FIG. 10, so that the push and release will be of the same velocity and the time of effectively massaging the suffering body part, that is, the time T of sufficiently applied force will be short, whereby the massaging operation is not only rendered mentally insufficient but also the massaging effect is factually insufficient.

The present invention has been thus suggested to solve such problems as above in the conventional apparatuses and is successful in realizing in all type massage apparatuses the most effective and ideal massaging mode in which the time of applying the sufficient force to the suffering body part is long enough, the push can be made slowly and the release can be made quickly as in the case of the manual operation.

A primary object of the present invention is, therefore, to provide a massage apparatus which is capable of performing an effective and comfortable massage having substantially the same massaging mode as in the case of the manual massage treatment by the massager.

Another object of the present invention is to provide a massage apparatus which establishes the above described object with a simple structure of driving mechanism.

A further object of the present invention is to provide a massage apparatus which establishes a strong and reliable force application with a driving mechanism employing gears.

Another object of the present invention is to provide a massage apparatus which can be movably mounted to a chair, bed or any other human body supporting instrument so as to be able to practice the massage with respect to different suffering parts of a user and thus to obtain a further massage effect.

Other objects and advantages of the present invention shall be made apparent as the following explanations of the invention advance as detailed with reference to preferred embodiments of the invention shown in accompanying drawings, in which.

Figure 1:
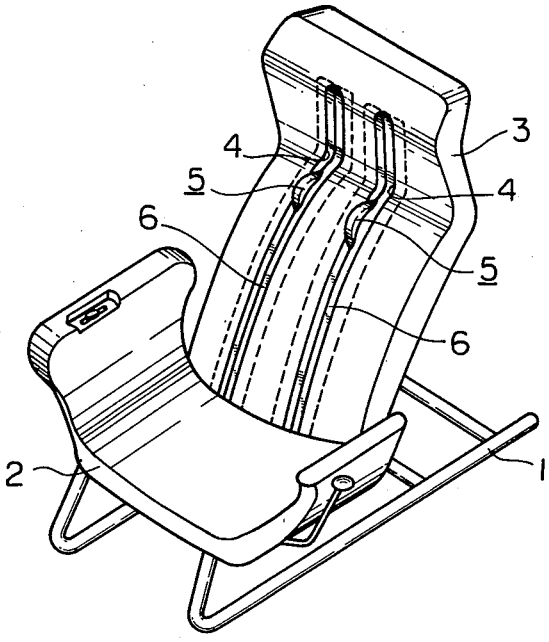
FIG. 1 is a perspective view showing a massage chair incorporating the massage apparatus according to the present invention.

Referring now to FIG. 1 showing a massage apparatus according to the present invention as incorporated in a chair, a base frame 1 is formed of bent pipe members, a seat 2 is secured onto the frame 1, and a back rest 3 is pivotally secured to the seat 2 so that the angle made by the seat 2 and back rest 3 will be variable and a reclining operation of the chair will be possible. Two vertical grooves 4 are provided in the front side of the back rest 3, a pair of disk-shaped massaging attachments 5 of the massage apparatus according to the present invention are partly projected out of the respective grooves 4, and yieldable cover members 6 are fitted to the respective grooves 4 to close them while allowing the attachments 5 projected. A mechanism for driving the attachments 5 is housed behind or inside the back rest 3.

Figure 4:
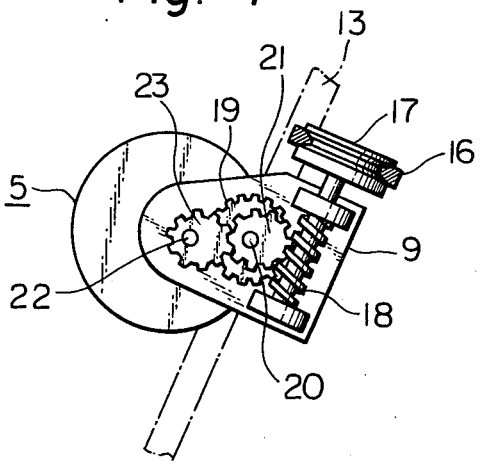
FIG. 4 shows essential parts in a side view of a driving force transmitting mechanism of the apparatus in FIG. 2.
Figure 2:
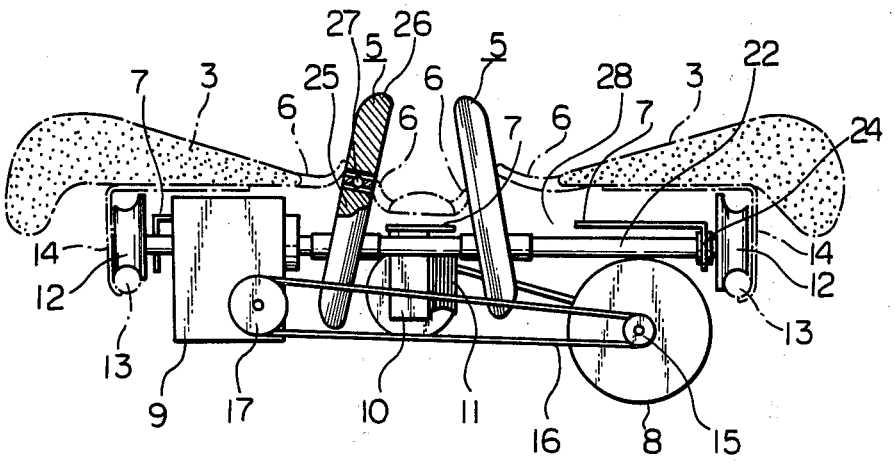
FIG. 2 is a plan view showing an embodiment of the massage apparatus of the present invention.
Figure 3:
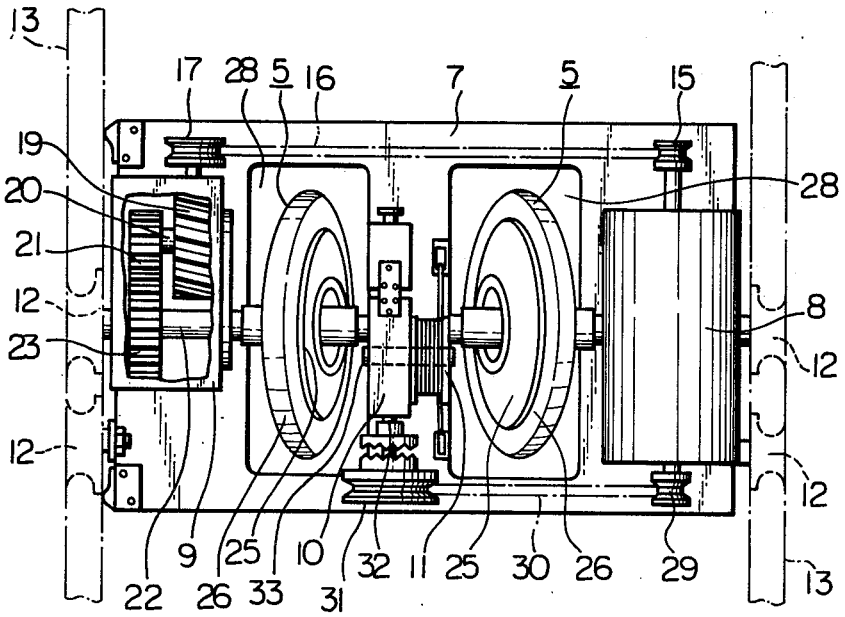
FIG. 3 is an elevation of the massage apparatus of FIG. 2.

Referring next to an embodiment of the massage apparatus according to the present invention shown in FIGS. 2 through 4, a motor 8 is arranged on one side of a frame plate 7, a driving gear box 9 is arranged on the other side, a vertical-motion gear box 10 and belt-winding drum 11 are disposed in the middle, and these members are fixed to the frame plate 7 as one block so as to balance the driving mechanism. A plurality of rollers 12 respectively provided on both sides of the block are made free to move along a pair of plate members 14 as idled on respective back frame members 13 to which the members 14 are secured. An output transmitted to rotate a belt pulley 17 of the gear box 9 through a V-belt 16 from an output shaft 15 of the motor 8 rotates a worm 18 (see FIG. 4) disposed inside the gear box 9. A driving side gear 21 comprising an eccentric elliptic gear is secured to a driving shaft 20 to which a worm wheel 19 meshing with the worm 18 is secured. A driven side gear 23 is secured to an operating shaft 22 for the attachments 5 and this gear 23 also comprises an eccentric elliptic gear. These driving side gear 21 and driven side gear 23 are made eccentric on one side respectively from the driving shaft 20 and operating shaft 22 by the same dimension so as to constantly mesh with each other and to form unequal velocity ratio gears. The operating shaft 22 is borne at one end by the driving gear box 9 and at the other end by a bearing part 24 formed by bending the frame plate 7. The massaging attachments 5 mounted to the operating shaft 22 respectively comprise an inner wheel 25 and outer wheel 26, and the inner wheel 25 is secured to the operating shaft 22 so as to be eccentric therewith and inclined with respect to the axial direction of the shaft. The outer wheel 26 is fitted around the inner wheel 25 through a ball bearing 27 so as to idle with respect to the inner wheel 25, while being partly projected out of the vertical grooves 4 through openings 28 in the frame plate 7. A driving power is transmitted to a belt pulley 31 of the vertical-motion gear box 10 through a V-belt 30 from another output shaft 29 of the motor 8. This belt pulley 31 also transmits the power to a worm shaft 32 projecting out of the vertical-motion gear box 10 so as to be a driving source for vertically shifting the massage apparatus by means of a vertical motion shaft 33 mounted to the belt-winding drum 11.

Figure 5A:
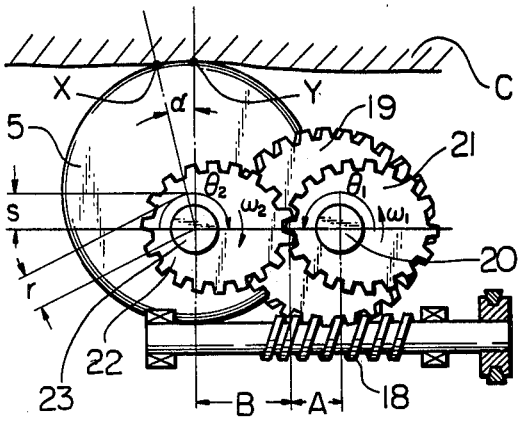
FIGS. 5A through 5C are similar side views showing other embodiments of the driving force transmitting mechanism according to the present invention.
Figure 5B:
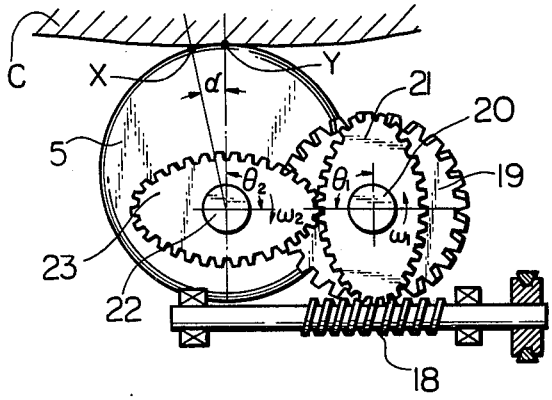
Figure 5C:
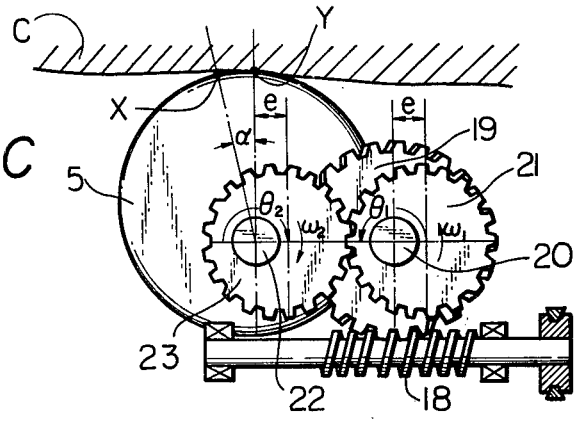

Referring to respective different patterns of gear arrangement of the unequal velocity ratio as shown in FIGS. 5A to 5C for driving the disk-shaped massaging attachments 5 which are eccentric by an amount r from the axis of the operating shaft 22, the respective driving side gear 21 and driven side gear 23 in a pattern of FIG. 5A are mounted to the driving shaft 22 and operating shaft 23 respectively at one of their focal points of the elliptic shape as their rotating centers and are meshed with each other so as to vary the angular velocity $\omega_2$ of the operating shaft 22 and to transmit the driving force of the shaft 20 which rotating at a constant angular velocity $\omega_1$ to the operating shaft 22 at a velocity change ratio of $\omega_2/\omega_1$. The gear arrangement is so set that, when the velocity change ratio is of the minimum value, that is, when the smallest meshing radius part A of the driving side gear 21 coincides with the largest meshing radius part B of the driven side gear 23 in their meshing relation, a peripheral part Y of the respective attachments 5 which is deviated by a phase angle $\alpha$ in the normal direction with respect to the rotating direction of the attachments 5 from the position of the maximum eccentricity of the attachments 5, that is, from an outer peripheral part X of the respective attachments 5 which is the farthest from the operating shaft 22 will push a suffering part C of the user's body, and a line connecting the part Y and the axis of the operating shaft 22 with each other will be at right angles with respect to a tangent between the attachments 5 and the suffering part C.

Figure 7A:
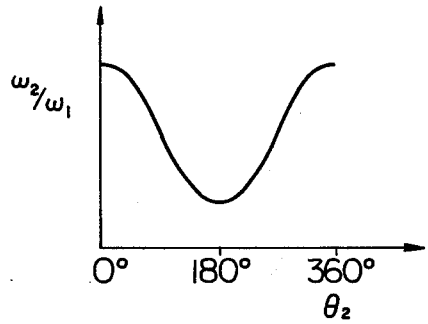
FIGS. 7A and 7B are characteristics diagrams showing velocity change ratios of gears respectively on the driving side and driven side of the massage apparatus according to the present invention.

It should be noted here that the state shown in FIG. 5A corresponds to a state at which $\theta_2=180°$ in the diagram of FIG. 7A.

In the case of FIG. 5B, next, elliptic system oval gears are used for the unequal velocity ratio gears which comprising the driving side gear 21 and driven side gear 23. In this pattern of the gear arrangement, rotating speed of the driven side gear 23 becomes slower and faster twice during each rotation of the driving side gear 21.

Figure 7B:
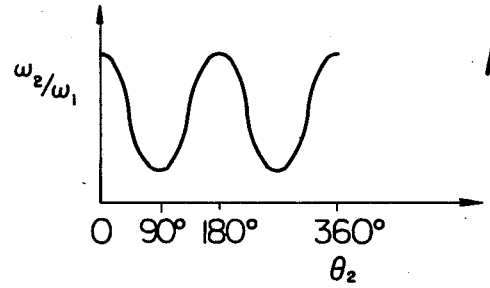

The state of FIG. 5B corresponds to a state at which $\theta=90°$ in the diagram of FIG. 7B.

In the case of FIG. 5C, further, the respective driving side gear 21 and driven side gear 23 are meshed with each other mutually in a relation of the same truly circular shape, and the respective operating shaft 22 and driving shaft 20 have their axes deviated by the same distance e from the respective centers of the driven side gear 23 and driving side gear 21.

Next, the manner in which the massaging attachments 5 are operated by the rotating motion of the motor 8 shall be explained in the following in comparison with the manner in the case of conventional apparatuses.

Now, when the motor 8 is rotated, the worm 18 is thereby rotated through the belt 16 and the driving shaft 20 is rotated by the rotation of the worm wheel 19 which meshing with the worm 18. Further, the operating shaft 22 will be rotated due to the meshing of the driving side gear 21 with the driven side gear 23, and such suffering part of the user's body as shoulders, waist or the like part can be properly massaged by the attachments 5 which are eccentrically provided with respect to the axis of the operating shaft 22.

Figure 6A:
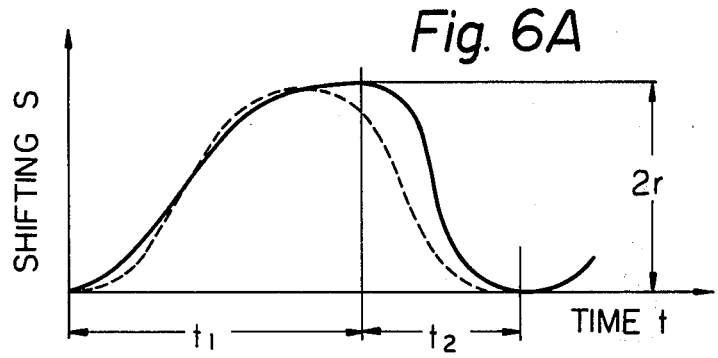
FIGS. 6A and 6B are diagrams showing massaging characteristics of the massage apparatus according to the present invention.

When the operating shaft 22 rotates at a constant angular velocity, as in the case of FIG. 5A, shiftings S of the largest eccentricity position of the respective attachments 5 with respect to the axis of the operating shaft 22 will be represented by a formula.

$$S=r\sin\theta$$

wherein r is the eccentricity and $\theta$ is shifting angle. If it is modified to be in the relation between the shifting and the time as represented by a broken line in FIG. 6A.

$$S=r(1-\cos\omega t)$$

wherein $\omega$ is the angular velocity of the operating shaft 22. In the drawing, $2r$ represents the maximum shifting. In this case, the applied force F to the suffering part with a conventional massage apparatus wherein the driven side and driving side gears are both of true circle and are not eccentric will be of a sine curve as shown by a broken line in FIG. 6B since the operating shaft rotates at a constant velocity, if the shifting S is considered to be directly proportional to the applied force F. However, in the preset invention, if the displacing angles of the driven side gear 23 and driving side gear 21 in the state of FIG. 5A are respectively $\theta_2$ and $\theta_1$ and the velocity changing ratio $\omega_2/\omega_1$ is represented by a function for the displacing angle $\theta_2$, the ratio will be approximated by a cosine curve as in FIG. 7B. Accordingly, the operating shaft 22 will be caused to rotate fast at one time but slowly at the other time. At the time of the slowest velocity of the operating shaft 22, the angular velocity of the largest eccentric part X will also become slow, the slow rotation of the operating shaft 22 will be added to the slow rotation of the largest eccentric part X and the particular part X will be caused to remain pushing long the suffering part C so that, as shown by a solid line in FIG. 6A, the shifting S of the largest eccentric part X will be extended long during this time and thus the force applying time with the massaging attachments 5 will become long. The shifting S herein referred to is a shift amount of a part of the outer periphery of the respective massaging attachments 5 in the direction of the normal between the respective attachments 5 and the suffering part C, the time t and shifting S of which being represented by the abscissa and ordinate, respectively, in the drawing, and it is shown that the attachments 5 are always in contact with the suffering body part C. Further, as the outer peripheral part Y of the respective attachments 5 massaging the suffering part C at the time of the slowest velocity of the operating shaft 22 is deviated by an amount of the phase angle $\alpha$ from the largest eccentric part X of the attachments 5, the time $t_1$ during which the attachments 5 rotate to cause their largest eccentric part X to reach the suffering part C will be longer than the time $t_2$ in which the largest eccentric part X separates from the suffering part C.

Figure 6B:
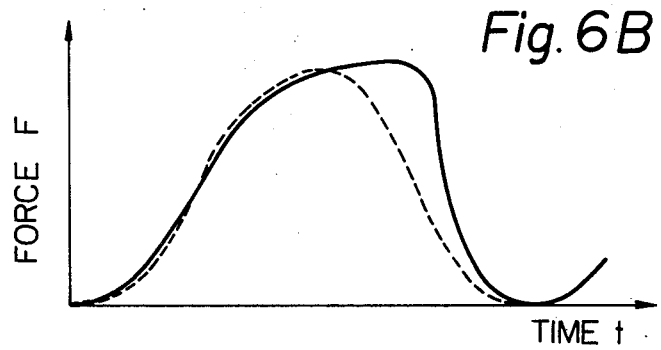

While the foregoing explanations have been made by taking the shifting of the massaging attachments in the direction of pushing the user's suffering body part on the ordinate, the characteristic curve of the applied force shows substantially the same trend as the curve of the shifting even if the force is taken on the ordinate, as shown in FIG. 6B, and the same explanations can be also applied thereto. This proves that, during the pushing of the suffering part by means of the massaging attachments 5, the pushing force is gradually increased but is quickly released from the suffering body part so that, as shown by the solid line in FIG. 6B, the pushing action will be performed with the gradually increased force for a longer time and the releasing action will be performed with the quickly reduced force for a shorter time.

Figure 8:
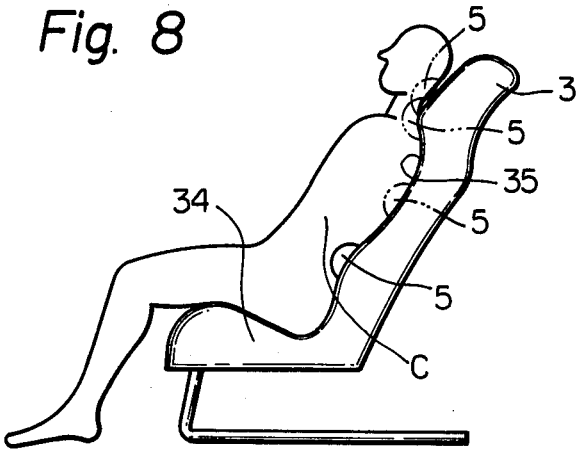
FIG. 8 is a schematic side view showing a chair adapted to apply the massage apparatus of the present invention.
Figure 9:
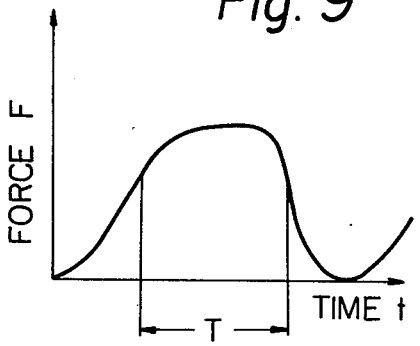
FIG. 9 is a diagram showing massaging characteristics of manual operation by a massager.
Figure 10:
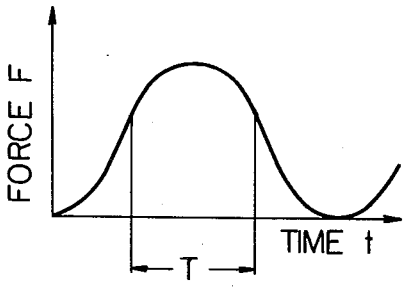
FIG. 10 is a diagram showing massaging characteristics of a conventional mechanical operation.

FIG. 8 shows the massage apparatus of the present invention as installed in a chair 34, wherein the massaging attachments 5 of the apparatus are disposed to project out of the front surface of the back rest 3 of the chair 34 so as to be movable vertically along the front surface with the rotation of the motor 8. Back resting surface 35 of the back rest 3 presents substantially an S-shape so as to be concave at positions opposing the head, back and hip parts of the user's body and convex at positions opposing the neck and waist parts to well fit the human body, whereby the massaging effect will be promoted.

What is claimed is:

1. A massage apparatus comprising a rotary driving source, a driving shaft rotated by said driving source, a driving side gear fixed to said driving shaft, an operating shaft having a driven side gear fixed to said operating shaft and being in mesh with said driving side gear to operatively associate therewith, and massaging attachments driven in response to rotations of the operating shaft, said driving side and driven side gears being arranged to provide an unequal velocity ratio with which rotating velocity of the driven side gear is varied by rotations of the driving side gear, and said massaging attachments being operatively associated with the operating shaft so as to perform a pushing action when said rotating velocity of the driven side gear thus varied is small and to perform a releasing action when the velocity is large.

2. A massage apparatus according to claim 1 wherein said driving side and driven side gears are of an elliptic shape.

3. A massage apparatus according to claim 1 wherein said driving side and driven side gears are of truly circle shape and eccentric with respect to said driving and operating shafts, respectively.

4. A massage apparatus according to claim 1 wherein said massage attachments are respectively of a disk member eccentrically mounted to said operating shaft.

5. A massage apparatus according to claim 4 wherein said pushing action of the massaging attachments is performed at an outer peripheral part of said disk member deviated by a phase angle $\alpha$ in nofmrl direction of rotations of the attachments from the farthest outer peripheral part of the disk member.

6. A massage apparatus according to claim 5 wherein said massaging attachments comprise a pair of disk members which are inclined with respect to the axis of the operating shaft respectively in opposite directions to one another.

7. A massage apparatus according to claim 6 which further comprises a chair for supporting said apparatus and the apparatus is installed to a back rest of said chair so as to be vertically movable along said back rest.

8. A massage apparatus according to claim 7 wherein said back rest is of a configuration fitting the back part of human body.

* * * * *